US006884045B2

(12) United States Patent
Kohlhase et al.

(10) Patent No.: US 6,884,045 B2
(45) Date of Patent: Apr. 26, 2005

(54) HYDRAULICALLY POWERED DIAPHRAGM PUMP WITH PRETENSIONED DIAPHRAGM

(75) Inventors: Nils Kohlhase, Leonberg (DE); Waldemar Horn, Wimsheim (DE); Ruediger Schnorr, Frankfurt am Main (DE)

(73) Assignee: Lewa Herbert Ott GmbH & Co., Leonberg (DE)

( * ) Notice: Subject to any disclaimer, the term of this patent is extended or adjusted under 35 U.S.C. 154(b) by 39 days.

(21) Appl. No.: 10/233,542

(22) Filed: Sep. 4, 2002

(65) Prior Publication Data

US 2003/0049145 A1 Mar. 13, 2003

(30) Foreign Application Priority Data

Sep. 7, 2001 (DE) ..... 101 43 978

(51) Int. Cl.[7] ..... F04B 43/06; F04B 17/00; F04B 19/00; F04B 39/10

(52) U.S. Cl. ..... 417/395; 417/413.1; 417/470; 417/570; 92/135

(58) Field of Search ..... 417/395, 413.1, 417/470, 471, 570, 571; 92/100, 130 R, 135

(56) References Cited

U.S. PATENT DOCUMENTS 2,546,302 A 5/1951 Gehres et al.
2,642,090 A * 6/1953 Barr ..... 92/100
2,653,552 A * 9/1953 Geeraert ..... 417/317
3,075,468 A * 1/1963 Eifel ..... 417/338
3,386,388 A * 6/1968 Rosenberg ..... 417/395
4,022,114 A * 5/1977 Hansen, III et al. ..... 92/98 R

FOREIGN PATENT DOCUMENTS

DE 1 034 030 7/1958
DE 25 26 925 9/1976
JP 403014930 A * 1/1991

* cited by examiner

*Primary Examiner*—Cheryl J. Tyler
*Assistant Examiner*—Timothy P. Solak
(74) *Attorney, Agent, or Firm*—Jacobson Holman PLLC

(57) ABSTRACT

A hydraulically driven diaphragm pump with a diaphragm clamped at its edge between a pump body and a pump cover separating a delivery chamber from a hydraulic chamber and pretensioned in the direction of its intake stroke by spring force. A hydraulic diaphragm drive in the form of an oscillating displacement piston is displaceable in the pump body between a reservoir chamber for the hydraulic fluid and the hydraulic chamber. The diaphragm is so strongly pretensioned by spring force that it exerts a substantial compressive force on the hydraulic fluid in the hydraulic chamber. Therefore a substantial hydrostatic pressure is built up in the hydraulic chamber relative to the delivery chamber.

9 Claims, 4 Drawing Sheets

HYDRAULICALLY POWERED DIAPHRAGM PUMP WITH PRETENSIONED DIAPHRAGM

FIELD OF THE INVENTION

The invention concerns a hydraulically powered diaphragm pump.

BACKGROUND OF THE INVENTION

In known diaphragm pumps of this generic type (DE-AS 1 034 030, DE-OS 25 26 925), the diaphragm is pretensioned with a compression spring. The compression spring is arranged either in the delivery chamber of the diaphragm pump or in its hydraulic chamber, and in such a manner that is assists the movement of the diaphragm in the direction of the suction stroke.

Since it is only a weak compression spring that is concerned here, it is also only a relatively light pretensioning of the diaphragm that is provided. This has the result that the diaphragm positional control is still not satisfactorily provided in every situation. Therefore, additional design elements are necessary for diaphragm positional control, which naturally complicate the structure of the diaphragm pump and thus make it more expensive.

In addition to this there is the fact that due to the slight pretensioning exercised by the relatively weak spring, gas formation in the hydraulic chamber is not effectively prevented during the suction stroke. Thus, because of the still present gas formation in the hydraulic chamber, the overall suction performance of the known diaphragm pumps is limited.

In diaphragm pumps of this generic type, their start-up reliability is of great significance. In modern diaphragm pumps, the lack of start-up reliability can be regarded as a distinct disadvantage. This is only rectified if additional design devices are present, although these bring additional costs. It is therefore desirable with such diaphragm pumps to have sufficient start-up reliability so as to ensure that—due to continuous internal leakage—when the pump is at a standstill, the diaphragm will still not move in the direction of the compression stroke even when there is a vacuum in the delivery chamber.

SUMMARY OF THE INVENTION

The invention is thus based on the aim of so designing the diaphragm pump of this generic type in order to rectify the aforementioned disadvantages that with a simple design, it still possesses a high level of dosing accuracy and that its suction power is not limited by gas formation in the hydraulic chamber so that starting up even from a vacuum is easily possible.

The diaphragm pump designed according to the invention is based on the essential concept of pretensioning the diaphragm with spring force so strongly that it exercises a considerable compression force on the hydraulic fluid in the hydraulic chamber and that therefore a substantial hydrostatic pressure is built up in the hydraulic chamber relative to the delivery chamber.

Advantageously, the spring is so dimensioned that the diaphragm follows the piston during the suction stroke even if there is a vacuum in the delivery chamber.

The diaphragm pump designed according to the invention also provides the desired start-up reliability. This is due to the fact that according to the invention, the spring is so dimensioned that when the pump is at a standstill the diaphragm does not move in the direction of the compression stroke even if there is a vacuum in the delivery chamber.

According to a preferred embodiment of the invention, the spring is so dimensioned that the pressure in the hydraulic chamber is always at least 1 bar greater than the pressure in the delivery chamber.

In particular, the design may be carried out in such a manner that the spring is so dimensioned that a differential pressure of at least 1 bar is always applied to the diaphragm.

Particular advantages may be achieved with the invention if the spring is so dimensioned that at no time during the suction stroke is there a vacuum pressure in the hydraulic chamber, until the diaphragm is mechanically supported on the pump body.

In a further development of the invention, the design may be so executed that the sum total of the differential pressure generated on the diaphragm by the spring force and the holding pressure of a sprung leakage compensating valve is always at least one bar. It is advantageous if the differential pressure on the diaphragm is very large compared with the holding pressure of the leakage compensating valve.

The dimensioning may, for instance, suitably be so achieved that the differential pressure on the diaphragm is dimensioned to be at least 0.8 bar and the holding pressure of the leakage compensating valve is dimensioned at about 0.3 bar.

In this amended embodiment of the invention, it is therefore advantageously possible to ensure the suction power of the pump—also from a vacuum—not only through the differential pressure on the diaphragm, but through the total of the differential pressure on the diaphragm and the holding pressure of the leakage compensating valve.

Provided the aforementioned total is greater than one bar, even in the presence of a vacuum, uncontrolled breathing should not take place. This ensures that the diaphragm follows the piston during the suction stroke, even under vacuum conditions.

If the differential pressure on the diaphragm is dimensioned, for instance, to 0.8 bar at the rear dead point of the diaphragm, a holding pressure of only 0.3 bar is necessary at the leakage compensating valve in order to achieve the total desired differential pressure of more than 1 bar.

During the leakage compensation process, a vacuum pressure of 0.3 bar arises in the hydraulic oil. Experience has shown that such low holding pressures at the leakage compensating valve produce no disadvantage in practice. In a corresponding manner, during the suction stroke and under vacuum conditions, a vacuum pressure of 0.2 bar arises in the hydraulic oil on the suction side given a differential pressure of 0.8 bar on the diaphragm.

Such low negative pressures bring with them no disadvantages in practice. Experience shows that the —unwanted—gas formation in hydraulic oils only occurs to a great extent at larger vacuum pressures, from about 0.4 bar.

Overall, this produces the advantage that due to the weaker spring loading that is possible, space and costs can be saved.

From the standpoint of the design, the invention may be advantageously realized in various ways and through various means. It is possible, for instance, to generate the strong spring force pretensioning the diaphragm in the direction of the suction stroke with the diaphragm itself, i.e. through its shape and/or material. In this regard, polytetrafluoroethylene (PTFE) comes into consideration as a material for the diaphragm, while a suitable diaphragm shape is given, for instance, by suitable preforming.

In a variant design embodiment, it is also possible according to the invention to generate the strong spring force pretensioning the diaphragm in the direction of the suction stroke with at least one spring element built into the diaphragm, for instance, a disk spring.

From the design standpoint, a particularly simple realization of the idea upon which the invention is based is provided if the strong spring force pretensioning the diaphragm in the direction of the suction stroke is generated by a compression spring arranged in the hydraulic chamber; this may be supported on a central guide rod connected to the diaphragm, on the pump housing at one end, and on the end of the guide rod at the other end, whereby its strength is dimensioned according to the effective diaphragm area.

It lies within the scope of the invention that the diaphragm is designed as a moulded diaphragm to adapt it to the differential pressure acting upon the differential pressure. A particularly advantageous design results if the moulded diaphragm has a peripheral bead whose concave side faces towards the hydraulic chamber. As a result of the differential pressure acting upon the diaphragm, the bead of the moulded diaphragm is stabilised by it. There is no resultant tendency towards bulging, so that the diaphragm has a long life expectancy. In addition, the tendency towards frictional wear with sandwich diaphragms is extremely low.

In a further embodiment of the invention, the diaphragm may be designed as a sandwich diaphragm with at least two diaphragm layers whose individual layers are mechanically coupled and, during the suction stroke, are pulled back by the spring action of the compression spring as a complete diaphragm packet.

It is also within the scope of the invention to realize the design such that the diaphragm is supported in its rear dead point position by a surface formed by part of the pump body and a diaphragm coupling disk.

Overall, therefore, the invention entails substantial advantages, which may be set out as follows, purely by way of example:

The suction power of the pump is not limited by unwanted gas formation in the hydraulic chamber, so that suction even from a vacuum is very readily possible. Thus the suction power of the diaphragm pump according to the invention corresponds to that of a piston pump.

The diaphragm pump according to the invention has a high dosing accuracy, since gas formation is entirely prevented by the vacuum pressure according to the invention which prevails in the hydraulic chamber.

Due to the design of the hydraulic pump according to the invention, it may be provided with a single simple leakage compensating valve, which has only a weak spring or no spring at all, so that during the leakage compensation process, hardly any gas formation takes place.

Due to the strongly reduced or completely prevented gas formation, greatly simplified gas removal from the hydraulic chamber results, so that no continuous gas removal is required.

The diaphragm pump according to the invention has a simple structure overall, so that no additional elements are required for diaphragm positional control.

The frequency of the pump drive is not limited by gas formation in the hydraulic chamber, so that high frequencies are possible.

Due to the pretensioning of the diaphragm with a spring force, the diaphragm is prevented from moving forward in the direction of the compression stroke when the pump is stationary, even if there is a vacuum in the delivery chamber.

Due to the hydrostatic pressure in the hydraulic chamber, the diaphragm is always curved in the direction of the delivery chamber, i.e. preshaped, so that its shape is stabilized.

BRIEF DESCRIPTION OF THE DRAWINGS

The invention will now be described in greater detail with reference to the drawings. These show.

DETAILED DESCRIPTION OF THE PREFERRED EMBODIMENTS

Figure 1:
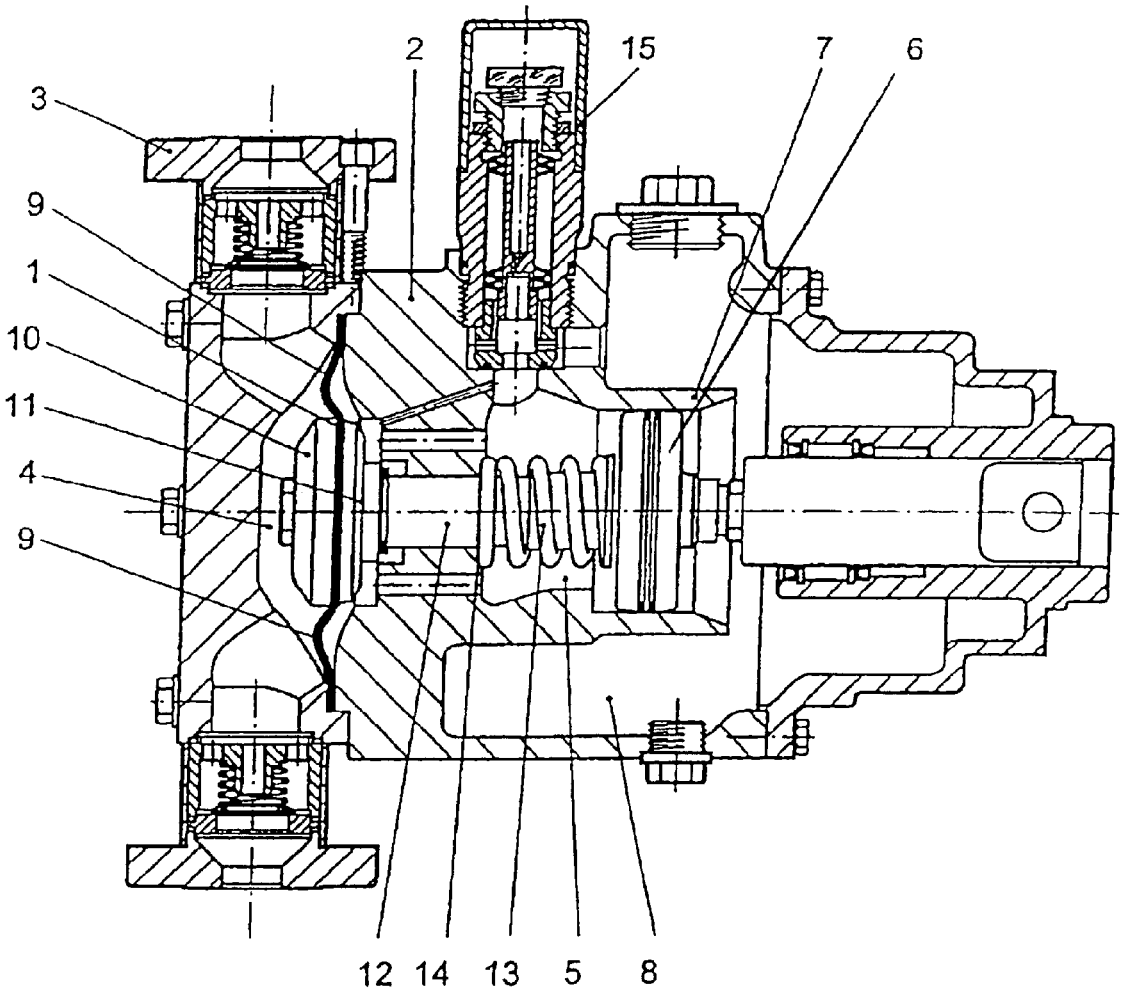
FIG. 1 illustrates a schematic representation of the diaphragm pump according to the invention in longitudinal section.

As can be seen from FIG. 1, the hydraulically powered diaphragm pump shown has a diaphragm 1, which is clamped at its edge between a pump body 2 and a pump cover 3 and separates a delivery chamber 4 from a hydraulic chamber 5.

The hydraulic drive of the diaphragm 1 is performed by an oscillating displacement piston 6, which is moveable back and forth in the pump body 2 in a sleeve 7 between the hydraulic chamber 5 and a reservoir chamber 8 for the hydraulic fluid.

The diaphragm 1 is designed in the embodiment shown as a three-layered sandwich diaphragm in the shape of a moulded diaphragm with a peripheral bead 9, whose concave side faces towards the hydraulic chamber 5.

The individual layers of the diaphragm 1, not shown in greater detail, are mechanically coupled in their central region by means of suitable disks 10, 11 which are linked, particularly screwed to each other. The disk 11 facing towards the hydraulic chamber 5 bears a central guide rod 12 which extends axially backwards into the hydraulic chamber 5. Arranged on this guide rod 12 is a strong compression spring 13 which rests at one end on a shoulder 14 of the pump body 2 and, at the other end, on the correspondingly shoulder-shaped end of the guide rod 12. Due to the strong spring force hereby exerted, the diaphragm 1 is always pretensioned in the direction of its suction stroke, i.e. its rear dead point. The strength of the compression spring 13 is so dimensioned that a considerable compressive force is exerted on the hydraulic fluid in the hydraulic chamber 5, so that a substantial hydrostatic pressure is built up in the hydraulic chamber 5 relative to the delivery chamber 4. In the example illustrated, this substantial hydrostatic pressure in the hydraulic chamber 5 is always at least 1 bar greater than the pressure in the delivery chamber 4.

Figure 2:
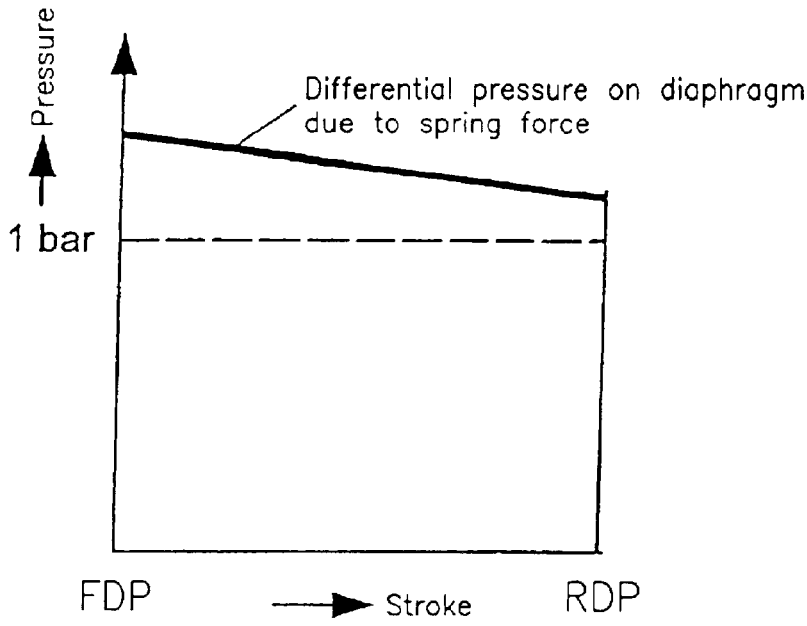
FIG. 2 illustrates a diagram of the differential pressure on the diaphragm over its stroke travel generated purely by the spring force.

In the diagram according to FIG. 2, the differential pressure on the diaphragm over its stroke path from the front dead point FDP to the rear dead point RDP is shown schematically, whereby the differential pressure on the diaphragm is generated here purely by the previously described spring 13. As can be seen, the spring 13 also generates a differential pressure in the rear dead point RDP of the diaphragm of at least 1 bar, so that there is thus always a substantial hydrostatic pressure in the hydraulic chamber 5 relative to the delivery chamber 4.

Figure 3:
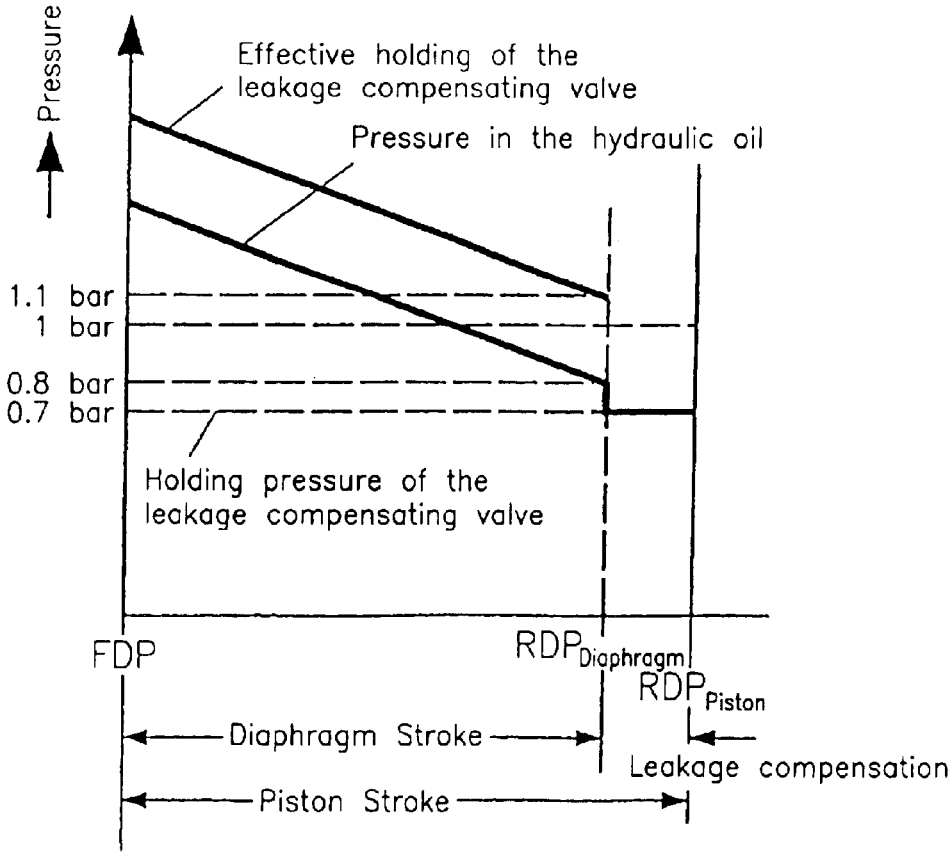
FIG. 3 illustrates a diagram of the pressure in the hydraulic oil under vacuum conditions on the suction side, whereby the spring force is so dimensioned that a differential pressure of at least 0.8 bar arises with a holding pressure in the leakage compensating valve of 0.3 bar.

In the diagram according to FIG. 3, with vacuum conditions on the suction side, the differential pressure on the diaphragm 1 (pressure in the hydraulic oil) is again represented. The differential pressure is generated by the spring force. The effective holding pressure of the leakage compensating valve 15 is also shown as the total of the differential pressure on the diaphragm 1 and the differential holding pressure of the leakage compensating valve 15 (see FIG. 1). It is always at least 1 bar. The embodiment may, for instance, be so executed that the differential pressure on the diaphragm 1 is at least 0.8 bar and that the differential holding pressure of the leakage compensating valve 15 is about 0.3 bar. The effective holding pressure at the rear dead point RDP of the diaphragm 1 is therefore at least 1.1 bar. With leakage compensation, the diaphragm 1 arrives at its rear dead point earlier than the piston 6. The pressure in the hydraulic oil then falls to 0.7 bar absolute, or to a vacuum pressure of 0.3 bar.

Figure 4:
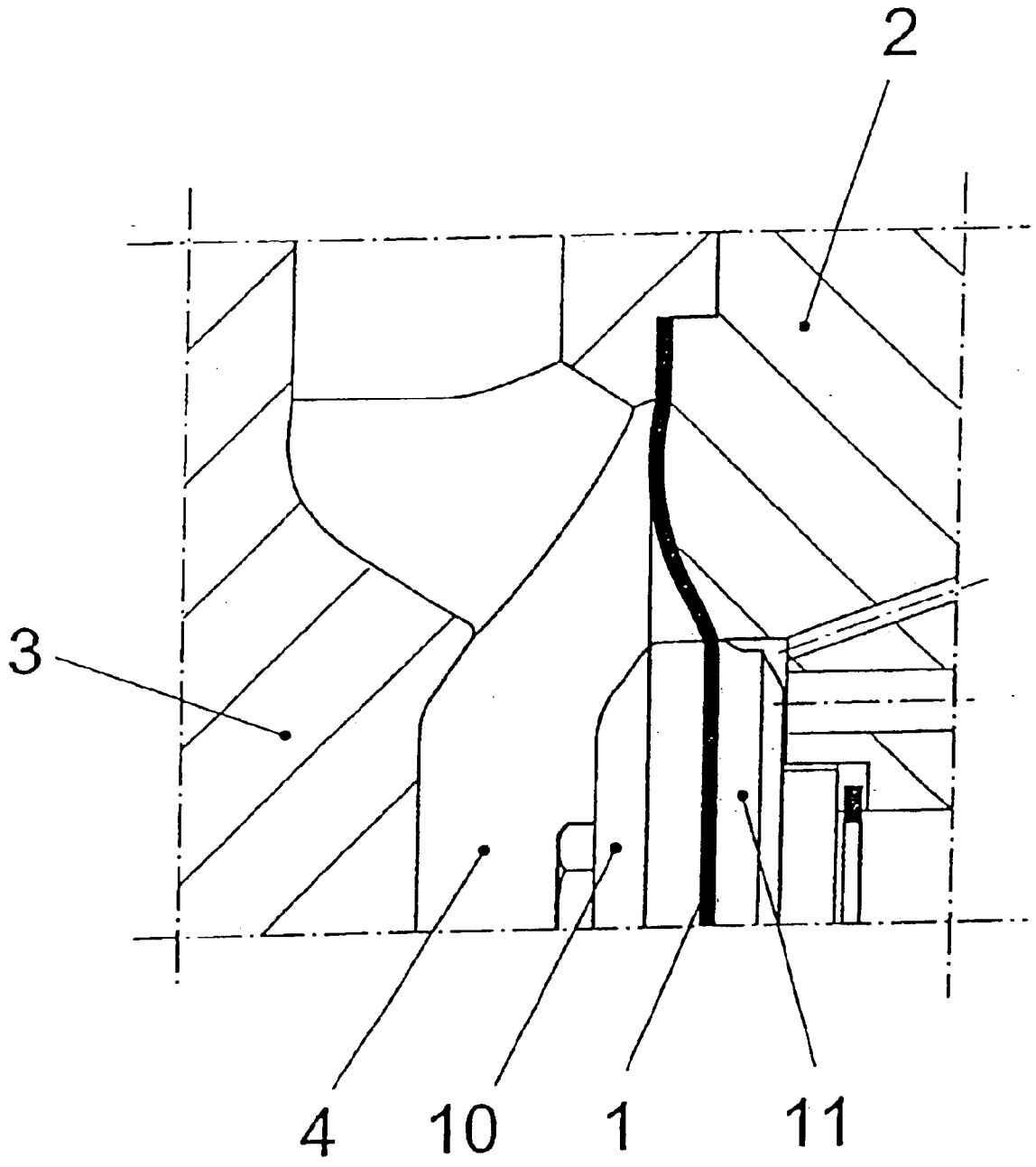
FIG. 4 illustrates schematically and in detail, a section through the diaphragm in its rear dead point position where it is supported on a surface formed by the pump body and the diaphragm coupling disk.

FIG. 4 shows the diaphragm 1 in its hydraulic-side position, i.e. in its rear dead point RDP. The design is so executed that the pump body 2 together with the rear diaphragm coupling disk 11 form a surface for supporting the diaphragm 1. As a result, the diaphragm can withstand differential pressures of up to 400 bar when static without suffering damage.

Figure 5:
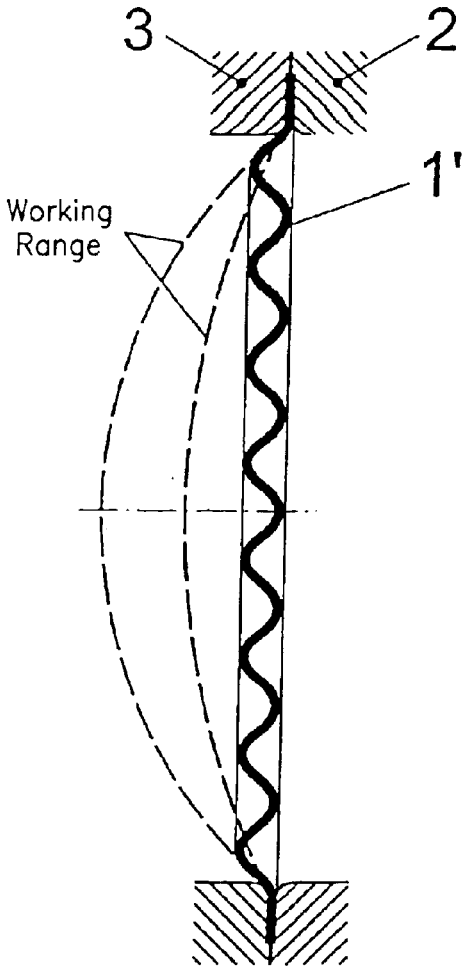
FIG. 5 illustrates the design of the diaphragm as a wave diaphragm whose intrinsic stiffness is used to generate a spring force.

In the embodiment shown by FIG. 5, the diaphragm 1' shown is formed as a wave diaphragm. Due to its construction, this has such a level of intrinsic stiffness that the wave diaphragm fulfils the function of the previously described compression spring 13 and may be used for generating the desired spring force on the diaphragm 1'. The dotted lines show the working range of such a wave diaphragm 1'.

Figure 6:
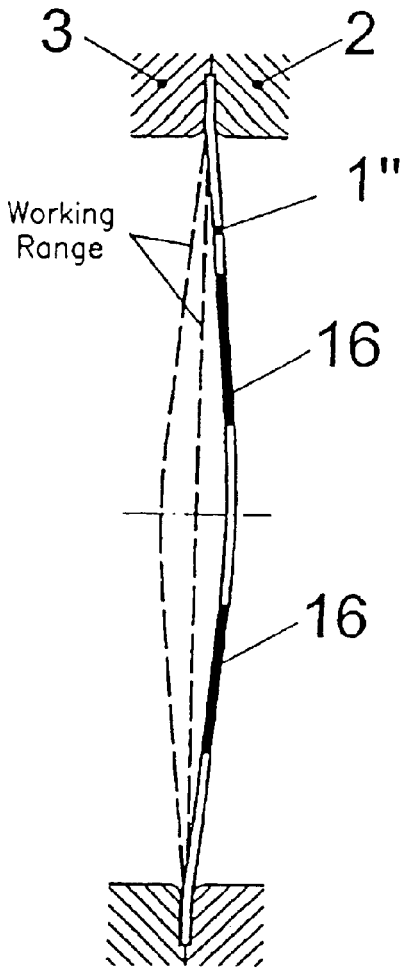
FIG. 6 illustrates the design of a diaphragm with an integrated disk spring for generating the desired spring force.

In the variant embodiment according to FIG. 6, the diaphragm 1" shown has integrated disk springs 16. These may, for instance, be vulcanized into an elastomer diaphragm and also fulfil the function to the extent that they pretension the diaphragm in the direction of its suction stroke with a strong spring force. Here, too, the dotted lines illustrate the working range of such a diaphragm 1".

Figure 7:
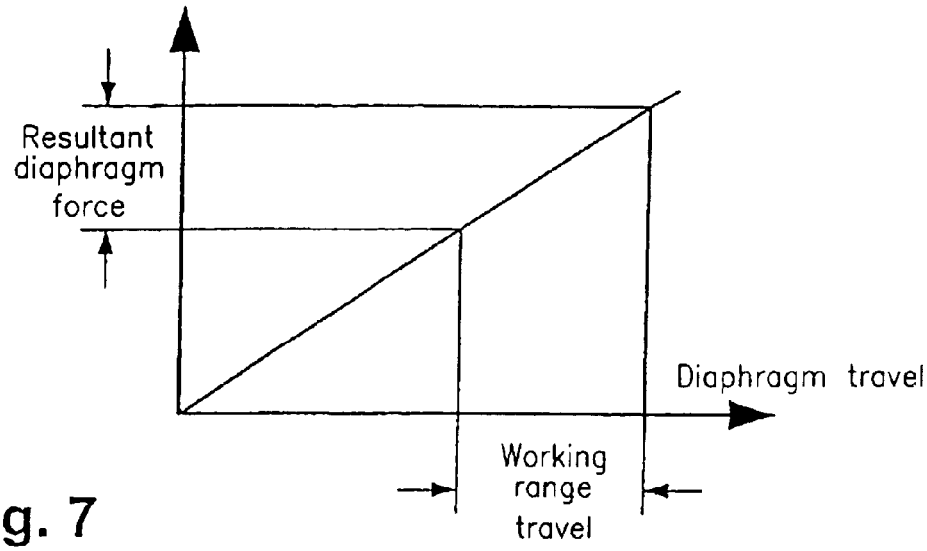
FIG. 7 illustrates schematically, a diagram of the usable working range of a diaphragm designed either as a wave diaphragm according to FIG. 5 or as a diaphragm with integrated disk spring according to FIG. 6.

FIG. 7 illustrates schematically the useful working range of one of the previously described diaphragms 1' or 1".

With regard to the features of the invention not described in greater detail above, reference is also expressly made to the drawings.

What is claimed is:

1. Hydraulically driven diaphragm pump comprising:

a pump body, a pump cover, an edge of a diaphragm clamped between the pump body and the pump cover, the diaphragm separating a delivery chamber from a hydraulic chamber, a spring force pretensioning the diaphragm in a direction of an intake stroke, and a hydraulic diaphragm drive including an oscillating displacement piston, said oscillating displacement piston being displaceable in the pump body between a reservoir chamber for hydraulic fluid and the hydraulic chamber, the diaphragm being pretensioned by the spring force so that only the spring force controls a position of the diaphragm and the diaphragm follows an intake stroke of the piston even when a vacuum is present in the delivery chamber, and, when the pump is static, the diaphragm does not move in a direction of a compression stroke due to internal leakage even when the vacuum is present in the delivery chamber while the diaphragm remains in a rear dead center position, the diaphragm being only supported by a surface that is formed by part of the pump body and by a diaphragm coupling disk, the spring force being so dimensioned that a pressure in the hydraulic chamber is always at least 1 bar greater than a positive pressure in the delivery chamber.

2. Diaphragm pump according to claim 1, wherein the spring force is so dimensioned that vacuum pressure is avoided in the hydraulic chamber at any time during the intake stroke.

3. Diaphragm pump according to claim 1, wherein a total of a pressure differential at the diaphragm and a differential holding pressure of a leakage compensating valve generated by the spring force is always at least 1 bar.

4. Diaphragm pump according to claim 3, wherein the pressure differential on the diaphragm is at least 0.8 bar and the differential holding pressure of the leakage compensating valve is at least approximately 0.3 bar.

5. Diaphragm pump according to claim 1, wherein the spring force pretensioning the diaphragm in the direction of the intake stroke is generated by the diaphragm.

6. Diaphragm pump according to claim 1, wherein the spring force pretensioning the diaphragm in the direction of the intake stroke is generated by at least one spring element incorporated into the diaphragm.

7. Diaphragm pump according to claim 1, wherein the spring force pretensioning the diaphragm in the direction of the intake stroke is generated by a compression spring arranged in the hydraulic chamber, supported by a central guide rod connected to the diaphragm, the compression spring having two ends with one end of the compression spring supported at the pump body and the other end of the compression spring supported at an end of the guide rod, said spring force corresponding to an effective diaphragm area.

8. Diaphragm pump according to claim 1, wherein the diaphragm is a molded diaphragm.

9. Diaphragm pump according to claim 8, wherein the molded diaphragm has a peripheral bead on a concave side face of the diaphragm facing towards the hydraulic chamber.

* * * * *